US005553680A

United States Patent [19]

Hathaway

[11] Patent Number: 5,553,680

[45] Date of Patent: Sep. 10, 1996

[54] HORIZONTAL DRILLING APPARATUS

[76] Inventor: Michael D. Hathaway, 3559A Red Cloud Ct., Ft. Meade, Md. 20755

[21] Appl. No.: 381,567

[22] Filed: Jan. 31, 1995

[51] Int. Cl.[6] ..... E21B 7/02; E21B 7/04

[52] U.S. Cl. ..... 175/78; 175/62; 175/162

[58] Field of Search ..... 175/62, 78, 77, 175/162, 210

[56] References Cited

U.S. PATENT DOCUMENTS

| | | | |
|---|---|---|---|
| 2,067,693 | 1/1937 | Carey | 255/1 |
| 2,516,421 | 7/1950 | Robertson | 255/1.6 |
| 2,546,670 | 3/1951 | Kirby | 255/1.4 |
| 2,631,821 | 3/1953 | Caldwell | 175/76 |
| 2,752,122 | 6/1956 | Hyatt et al. | 175/62 X |
| 2,778,603 | 1/1957 | McCune et al. | 255/1.6 |
| 2,889,137 | 6/1959 | Walker | 255/20 |
| 2,936,411 | 5/1960 | Doty | 317/246 |
| 4,365,676 | 12/1982 | Boyadjieff et al. | 175/78 X |
| 4,691,788 | 9/1987 | Yoshida et al. | 175/62 |
| 5,286,144 | 2/1994 | Griner | 166/55.2 |
| 5,392,861 | 2/1995 | Champagne | 166/77 X |
| 5,425,429 | 6/1995 | Thompson | 175/62 |
| 5,439,066 | 8/1995 | Gipson | 175/77 X |

FOREIGN PATENT DOCUMENTS

| | | | |
|---|---|---|---|
| 213583 | 8/1990 | Japan | 175/78 |
| 3194094 | 8/1991 | Japan | 175/78 |
| 5156883 | 6/1993 | Japan | 175/62 |

*Primary Examiner*—Hoang C. Dang

[57] ABSTRACT

Disclosed herein is a horizontal boring apparatus which is comprised of a remotely controlled drilling tool lowered from a self-contained vehicle into a previously drilled vertical shaft. The tool mills away a 360 degree band of metal casing adjacent to the desired area to be bored, and extends a hydraulic powered rotary drilling tool into the formation by extending and retracting a telescoping base while alternating stabilization of the base and bit end of the drilling tool much like an inch worm. The tool is designed to drill a 1 inch bore hole up to 150 feet in any direction, or several directions. The tool and tool housing contain instrumentation for sensing direction, inclination, density, and temperature.

16 Claims, 4 Drawing Sheets

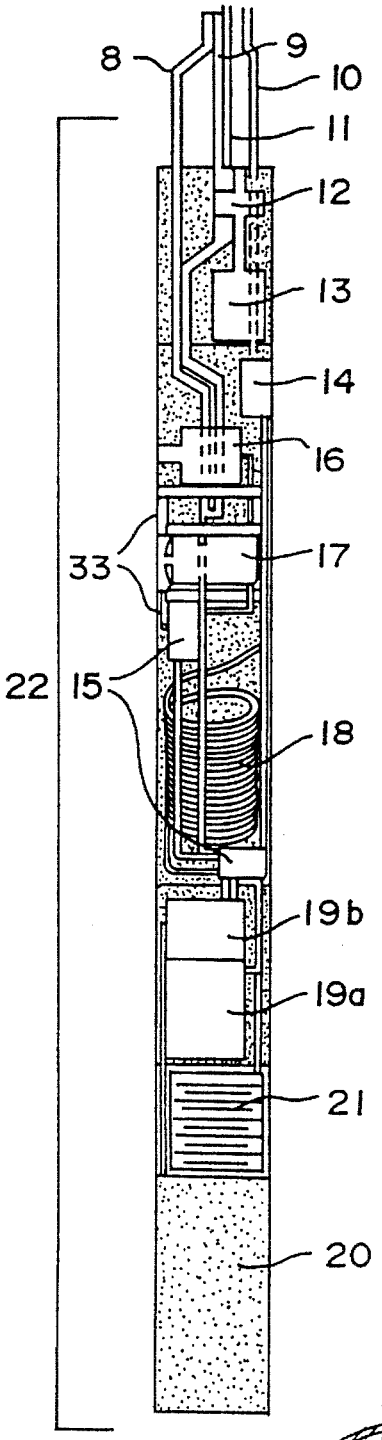
FIG. 2
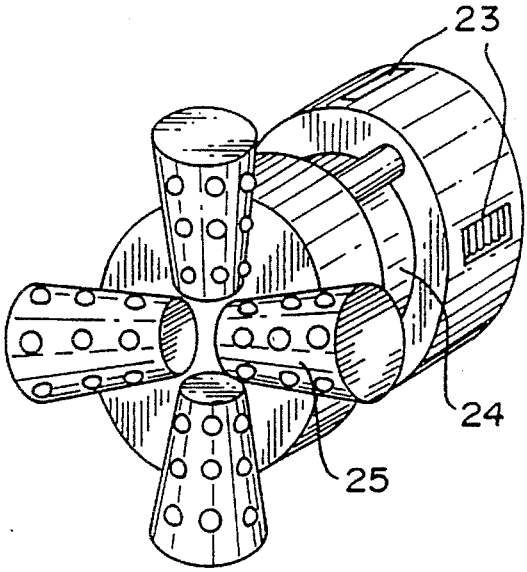
FIG. 3
FIG. 6
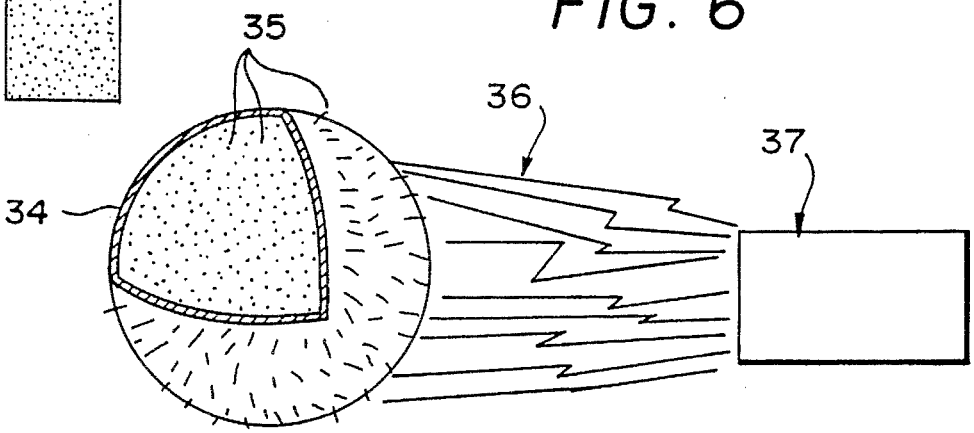

FIG. 4a
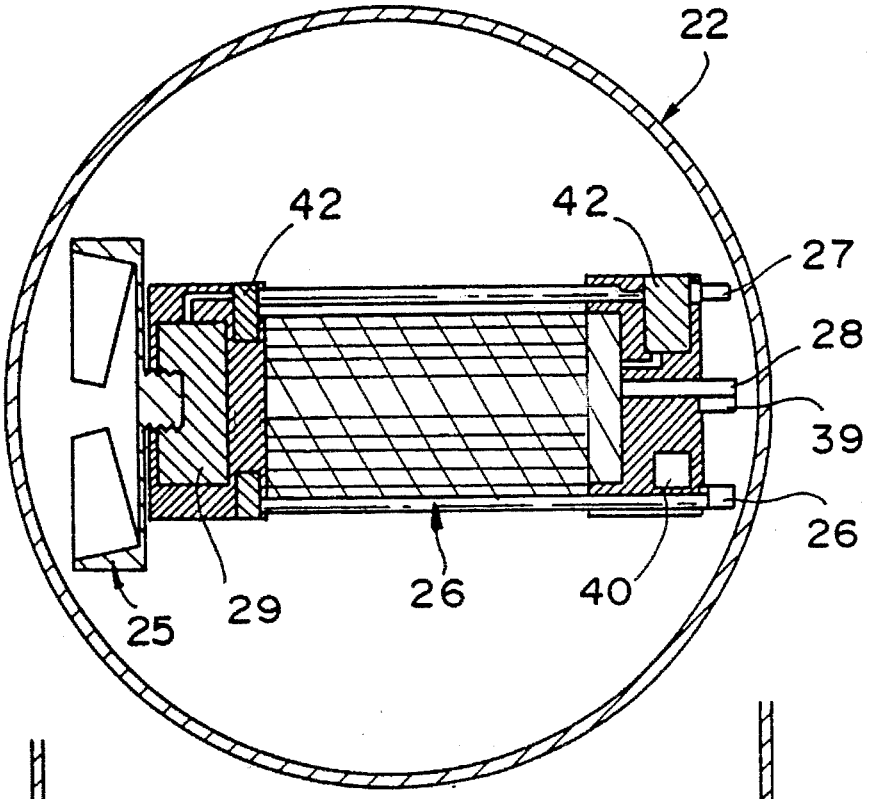
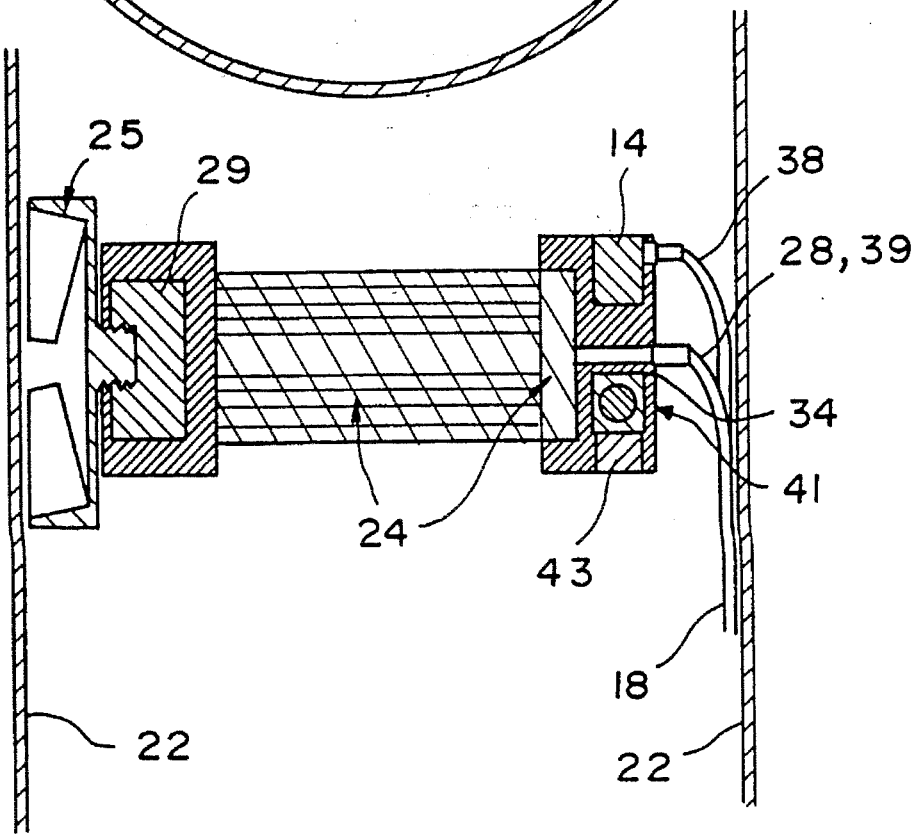
FIG. 4b

FIG. 5a
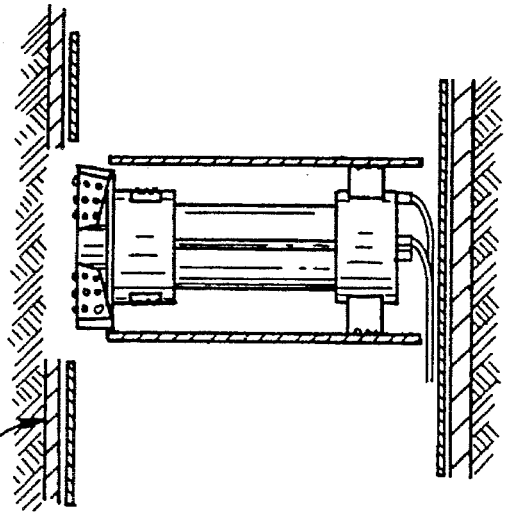
FIG. 5b
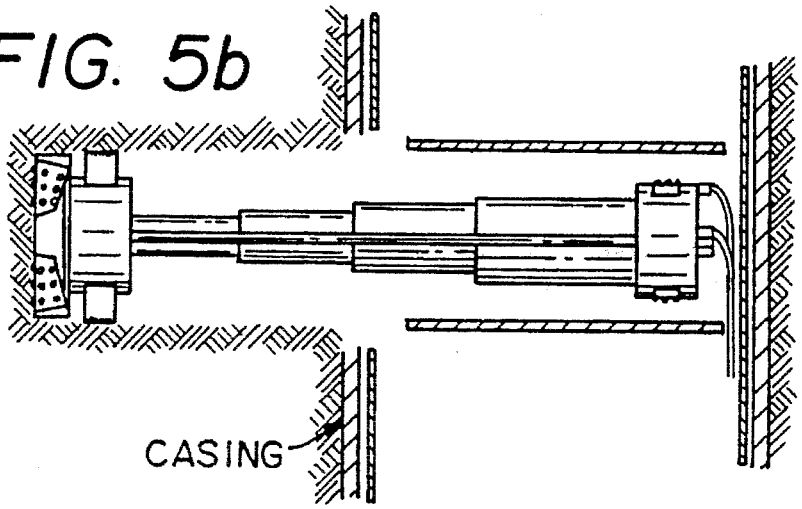
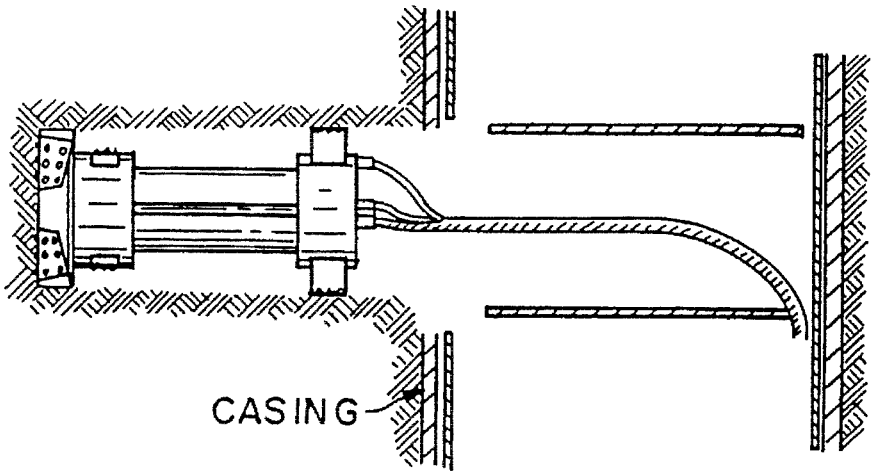
FIG. 5c

HORIZONTAL DRILLING APPARATUS

BACKGROUND OF THE INVENTION

This invention relates generally to using a remotely controlled horizontal drilling apparatus lowered from a self-contained vehicle into a previously drilled vertical shaft. More specifically, this invention bores multiple horizontal bore holes in different directions and at multiple levels. Drilling direction, both vertical and horizontal, can be controlled from the self-contained vehicle.

It is well established that current methodologies for completing oil and gas wells does not work well in many cases, sometimes missing the production zones altogether, or damaging the zone or casing sufficiently to render the well unusable. Additionally, over time, most wells will begin to slow production due to plugging up of the formation porosity due to movement of impurities and solids due to high pressures through small completion surface areas. Over time, several methodologies have been employed to improve porosity and surface area after initial completion. These have included use of chemicals, forcing holes into the formation using high pressure, and others.

The horizontal drilling apparatus was developed in an effort to improve production zone surface area, reach pristine formation material not contaminated by the vertical drilling operation, and allow multiple horizontal bores at multiple levels. Added to this capability is a self-contained vehicle which controls well pressures while drilling, direction and length of bore hole, and well bore mapping and monitoring functions.

DISCUSSION OF PRIOR ART

Numerous attempts have been made to provide an efficient and effective horizontal drilling apparatus for use by the oil drilling industry. To date, however, no fully successful system or apparatus has been developed.

The following patents represent the closest prior art relating to the instant invention which is known to the inventor:

U.S. Pat. No. 2,067,693 Carey May 3, 1936
U.S. Pat. No. 2,516,421 Robertson Aug. 6, 1945
U.S. Pat. No. 2,546,670 Kirby Mar. 27, 1951
U.S. Pat. No. 2,778,603 McCune et al. Jan. 27, 1957
U.S. Pat. No. 2,889,137 Walker Feb. 13, 1958
U.S. Pat. No. 2,936,411 Doty Nov. 29, 1955
U.S. Pat. No. 5,286,144 Gainer Aug. 5, 1991

The Carey and Kirby patents are related only to sample cores and are not concerned with actual drilling. The Robertson, McCune et al., and Walker patents, while concerned with lateral drilling, do not show precise control means for vertical and horizontal drilling contemplated by the present invention. The Dody patent is interesting in that it does pertain to a ball tilt sensitive inclinometer employing mercury as the switch contact used in oil drilling operations but not of the type envisioned by this invention. The Gainer patent shows an apparatus for horizontal reaming a well shaft liner whose mechanism moves the apparatus both vertically and horizontally. The above discussed patents are merely background references which pertain to, but which do not show, the invention described herein below.

SUMMARY OF THE INVENTION

The object of this invention is to drill single or multiple horizontal bore holes from an existing vertical well bore at single or multiple levels.

An additional object of this invention is to monitor and map the vertical and horizontal bore holes in order to guarantee the horizontal bore holes remain in the most productive regions of the production zone.

An additional object of this invention is to provide a self-contained vehicle which attaches and seals to the well head allowing for well pressure control while drilling to minimize fluid requirements and negative impact on the environment.

An additional object of this invention is to completely remove the well casing over the production zone area(s) that will be horizontally drilled.

BRIEF DESCRIPTION OF THE DRAWINGS

FIG. 2 is a sectioned view of the tool housing with all internal sections;

FIG. 3 is a perspective view of the drilling device in a partially extended mode;

FIG. 4*a* is a sectioned top view of the drilling device inside the tool housing;

FIG. 4*b* is a sectioned side view of the drilling device inside the tool housing;

FIG. 5*a* is a side view of the drilling tool contracted inside the tool housing;

FIG. 5*b* is a side view of the drilling tool extended after drilling into the rock formation;

FIG. 5*c* is a side view of the drilling tool contracted in the rock formation ready to extend again and continue drilling;

FIG. 6 is a partially sectioned view of the mercury ball inclinometer.

DESCRIPTION OF THE PREFERRED EMBODIMENTS

Figure 1A:
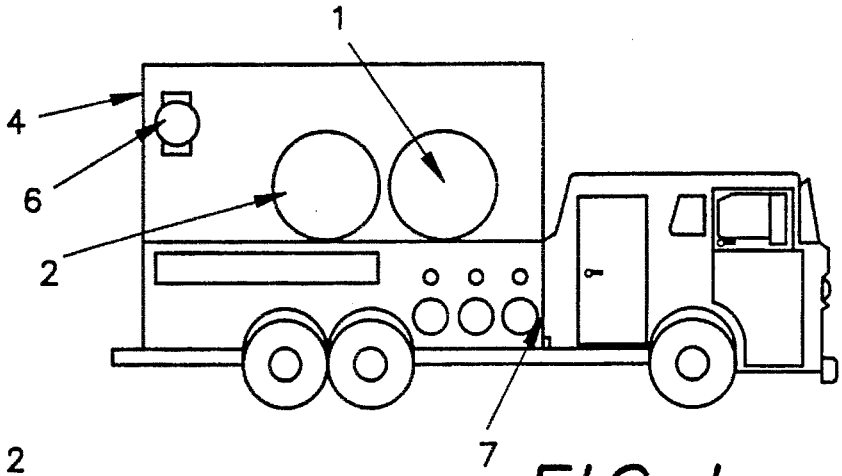
FIG. 1*a* is a side view of the truck mounted horizontal drilling system in the lowered position.
Figure 1B:
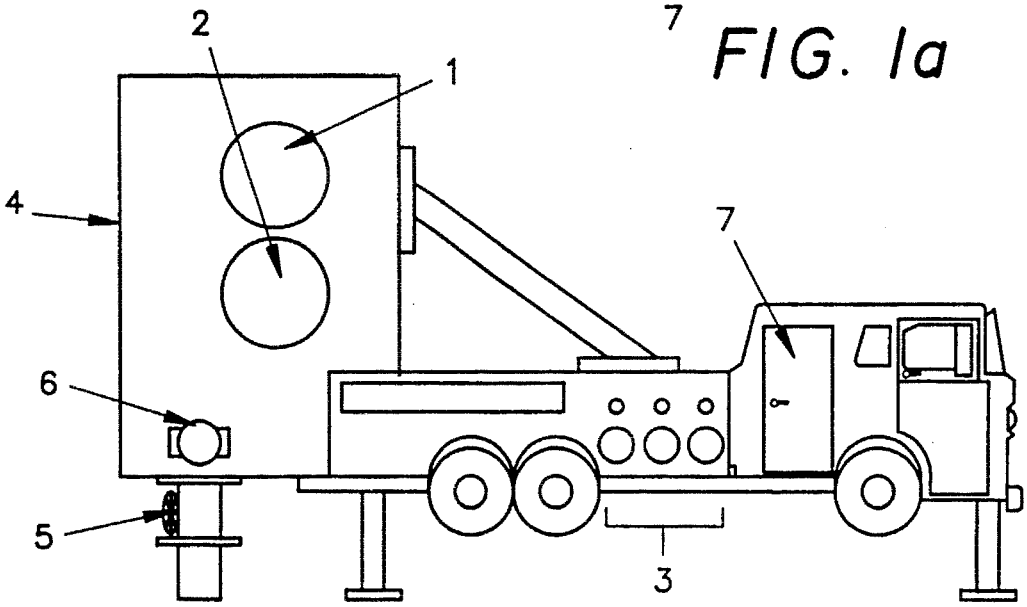
FIG. 1*b* is a side view of the truck mounted horizontal drilling system in the raised position attached to a well head.
Figure 1C:
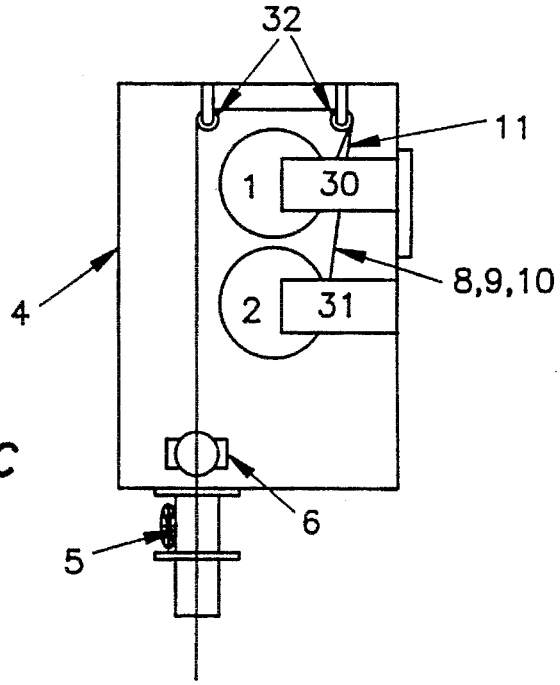
FIG. 1*c* is a detailed view of the sealed cable delivery container.

The apparatus of the invention is hereafter referred to as a MOLE. The MOLE is a subsurface, horizontal boring tool developed for the main purpose of completing oil and gas wells by drilling several horizontal bore holes outward from the primary vertical well bore. These horizontal bore holes are limited in size and length by the diameter of the vertical bore hole, and the length of umbilical cable stored in the MOLE tool, but are initially designed for a 1 inch bore hole for up to 150 feet in length. The MOLE carries sufficient instrumentation and a computer processor to accurately control and report the vertical and horizontal position of the boring device, as well as digital mapping of the bore holes in relation to the original vertical well bore and the surface location of the top of the vertical well bore. The MOLE is a system (FIG. 1) comprised of a surface control unit (truck mounted), and a tool housing. The surface control unit (FIG. 1) houses the cable lowering system, fluid pumping system, pressure control system, and main computer system. The cable lowering system is two cable drums; one drum 1 lowers and raises a steel braided cable 11 routed across two steering rollers 32 attached to the tool housing 22, one drum 2 lowers the drilling fluid primary 8 and return 9 tubing and electronics control cable 10. The drums are attached 30 & 31 to the side of a sealed cable delivery container 4. The fluid pumping system 3 pumps a viscous drilling fluid through primary flexible tubing 8 down a previously drilled vertical well bore to the tool housing 22. The sealed cable delivery container 4 encases the drums and attaches directly to the well head of the previously drilled vertical well bore 5. This controls well pressures while drilling to prevent a well blowout. The sealed cable delivery container includes hydraulic blowout preventers 6 which can be closed in the event of a well blowout. A main computer system is located in a controlled environment compartment 7 in the rear of the truck cab. It plots elevation, direction and location of the horizontal bores and the boring tool, as well as temperature, pressure, and density changes while drilling. Standard programming techniques are used to generate visual digital representations of the operations of the tool and environmental changes while drilling.

The tool housing 22 (FIG. 2) is connected to the surface control unit by a steel braided cable 11, primary 8 and return 9 drilling fluid tubing, and an electronic data transmission cable 10.

The tool control unit 14 is located in the upper part of the tool. It contains a microprocessor and all the circuitry and sending/receiving systems to control the tool and report all data to the surface control unit. Information is transmitted to the surface control unit by way of the communications cable 10 using both digital and analog signals. It also houses a pressure sensor and a direction sensor.

A power unit generates sufficient DC electrical power to drive all the instrumentation, devices and motors within the tool. It is driven by drilling fluid passing across power impellers 12 attached to the shaft of a DC generator 13. It is located in the upper portion of the tool.

A casing removal unit uses a small hydraulic powered milling device 16 which when activated extends through a rotating opening and mills away a band of casing just larger than the width of the boring tool from the entire circumference of the well casing.

A storage area is directly below the MOLE 17 and stores the umbilici 18 in a coiled fashion. The storage area can be constructed large enough to hold several hundred feet of umbilici.

A hydraulic unit includes a DC powered motor 19*a* driving a high pressure hydraulic pump 19*b*. The hydraulic pressure generated is used to drive the milling tool and MOLE. Hydraulic functions are operated by two valve blocks 15 controlled by the tool control unit 14.

A hydraulic fluid reservoir 20 stores sufficient hydraulic fluid for operation of all devices in the tool.

The MOLE unit (FIGS. 3, 4, and 5) is the actual horizontal boring tool. It has a cone bit 25 powered by a small hydraulic motor 29 with hydraulic side stabilizers 23, a hydraulic telescoping base 24, and instrumentation for measuring temperature 40, density 43, and inclination 41. By manipulating the side stabilizers 23 and the hydraulic base 24 through hydraulic valve blocks 42, the mole can be forced to drill horizontally, much like an inch worm (see FIG. 5), moving the length of the telescope base by first stabilizing the base end of the tool with the side stabilizers 23 on the base, extending the telescope while drilling (FIG. 5*a*), stabilizing the side stabilizers 23 on the bit end, retracting the side stabilizers 23 on the base, and retracting the base toward the bit end of the tool (FIG. 5*b*), and then repeating the process. The drilling process is managed by a mole control unit 14 in the mole and the tool control unit 37 in tool housing. Progress, location, and other data is relayed to the surface control unit as the tool bores into the formation. The MOLE is tethered to the tool housing by an umbilici 18 of two hydraulic lines 27 & 28, one drilling fluid tube 26, an electronic control cable 38, and a steel braided cable 39. The MOLE is recovered into the tool housing 22 when the bore is complete by retracting the steel cable 39 and coiling the umbilici 18 below the mole in the tool housing 22. The unit also has a cable shear (FIG. 2) 33 to sever the umbilici in case of an emergency, allowing easy extraction of the tool housing. A mercury ball inclinometer 34 (FIG. 6) in the MOLE is of a new design using mercury conduction is a small round ball with hundreds of small contacts 35 exposed within the ball. As the ball rotates in any direction, the mercury flows to the bottom of the ball, changing which contacts touch the mercury. By monitoring the contacts shorted by the mercury with electronic sensing circuitry located in the tool control unit 14, the exact attitude of the ball, and hence the device holding the ball can be plotted and monitored continuously. As the contacts are shorted by the mercury, a microprocessor tracks which contacts are shorted at any given time. This information is used as input for an algorithm that plots the attitude of the ball given the specific contacts that are shorted. The algorithm outputs the attitude data through the electronic control cable 38 to the tool control unit 37 and up the hole to the surface control unit where the operator can monitor and direct the mole based on attitude information.

What I claim as new and novel and desire to protect is:

1. A horizontal drilling apparatus for use in a predrilled vertical well bore casing having a casing head comprising a self contained vehicle provided with a sealed cable delivery container having therein cable means for raising and lowering a multi-directional horizontal drilling tool, said vehicle also provided with a fluid pumping system for pumping drilling fluid to the drilling tools, said sealed cable delivery container having means for direct attachment to the casing head of the vertical well bore, said apparatus including a computerized drilling control station for the operator control of all drilling operations, and said apparatus further including a multi-directional horizontal drilling tool that is lowered into the predrilled well bore by said cable means from the self contained vehicle.

2. A horizontal drilling apparatus as defined in claim 1 wherein said sealed cable delivery container has connector means for removably attaching said apparatus to the vertical bore casing head which allows control of well pressures and fluids during drilling to prevent environment contamination and dangers of high pressure petroleum production formation.

3. A horizontal drilling apparatus as defined in claim 1 including a hydraulic controlled sealing ram located in said vehicle that when activated, will seal the well casing head in the event of an emergency.

4. A horizontal drilling apparatus as defined in claim 1 including a computer processor that uses data received from said drilling tool to map and monitor all drilling operations.

5. A horizontal drilling apparatus as defined in claim 1 including sensor means for detecting density, temperature, pressure, inclination, and direction and for relaying data detected by said sensor means to the said self-contained vehicle which uses the data to map and monitor all drilling operations.

6. A horizontal drilling apparatus as defined in claim 1 including an electric generator powered by pressurized fluids being pumped past impellers attached to the generator shaft.

7. A horizontal drilling apparatus as defined in claim 1 including a hydraulic powered casing reamer that is extendable into the well bore casing, rotatable 360 degrees, and moveable up and down as needed to remove well bore casing prior to horizontal drilling operations.

8. A horizontal drilling apparatus as defined in claim 1 wherein said horizontal drilling tool is a hydraulic powered rotary drill that is extendable into the side of said predrilled vertical bore with progressive telescoping movement.

9. A horizontal drilling apparatus as defined in claim 7 wherein said fluid pumping system includes a hydraulic pump and hydraulic fluid reservoir which powers said reamer.

10. A horizontal drilling apparatus as defined in claim 8 including an inclination sensor to monitor vertical deflection of said rotary drill while drilling, and includes means for sending deflection data to the self-contained vehicle while drilling.

11. A horizontal drilling apparatus as defined in claim 6 including a battery backup to ensure sufficient operations of said horizontal drilling tool in event of power loss from said generator.

12. A horizontal drilling apparatus as defined in claim 8 wherein said fluid pumping system includes a hydraulic pump and hydraulic fluid reservoir which powers said rotary drill.

13. A horizontal drilling apparatus as defined in claim 10, wherein said inclination sensor is a mercury ball.

14. A horizontal drilling apparatus as in claim 8 wherein said hydraulic powered rotary drill is provided with side stabilizers permitting anchoring of one portion of the drill while extending a movable telescoping portion thereof horizontally to perform the drilling operation.

15. A horizontal drilling system for use in a predrilled well bore casing including a wellhead comprising a self-contained vehicle that can be coupled directly to said wellhead, said vehicle provided with a sealed cable delivery container having means for attachment to said wellhead; cable means within the container for lowering and raising a directional drilling tool into and out of the well bore casing; a directional drilling tool for drilling a lateral borehole from the well bore casing; a fluid pumping system for supplying drilling fluid to said drilling tool and a computerized drilling control means for operator control of all drilling operations.

16. A horizontal drilling apparatus as defined in claim 15 wherein sensor means for communicating with said computerized drilling control means for detecting and monitoring drilling operations are provided in said drilling tool.

* * * * *